US005810640A

United States Patent [19]

Clarke et al.

[11] Patent Number: 5,810,640

[45] Date of Patent: Sep. 22, 1998

[54] MAGNETIC GEL TOY AND METHOD FOR MAKING

[75] Inventors: Thomas L. Clarke; Jocelyn E. Clarke, both of Oviedo, Fla.

[73] Assignee: General Research and Device Corporation, Oviedo, Fla.

[21] Appl. No.: 669,756

[22] Filed: Jun. 26, 1996

Related U.S. Application Data

[63] Continuation-in-part of Ser. No. 406,023, Mar. 17, 1995, abandoned.

[51] Int. Cl.[6] ..... A63H 33/26; H01F 1/00

[52] U.S. Cl. ..... 446/132; 446/129; 335/219; 335/296

[58] Field of Search ..... 446/132, 129, 446/133–135; 335/219, 296

[56] References Cited

U.S. PATENT DOCUMENTS

| | | | |
|---|---|---|---|
| 2,836,931 | 6/1958 | Brennan . | |
| 3,032,926 | 5/1962 | Lang . | |
| 3,965,613 | 6/1976 | Saunders | 446/132 |
| 4,110,236 | 8/1978 | Molina | 252/62.54 |
| 4,375,733 | 3/1983 | Callais, Jr. | 446/39 X |
| 5,153,254 | 10/1992 | Chen | 524/505 |

FOREIGN PATENT DOCUMENTS 472798 12/1914 France .

*Primary Examiner*—Mickey Yu

*Attorney, Agent, or Firm*—Brian S. Steinberger; Law Offices of Brian S. Steinberger

[57] ABSTRACT

Novel magnetic gel materials useful as toys, playthings and novelties and a method for making same. These materials should also prove useful in other fields where ferrofluids and other magnetic liquids have found use when the plastic mechanical properties of the gel are not a limitation. The novel invention produces a magnetic material that exhibits the soft, thixotropic properties of play gels. A gelatinous material such as a silicone gel has a fine magnetic powder dispersed throughout by kneading into a substantially uniform mixture at ambient/room temperature. The advantage of this method for producing magnetic gel over the alternative of adding a gelling agent to an existing ferrofluid are simplicity and the ability to choose the properties of the gelatinous material independently of the need for a carrier fluid. Various types of toy applications include resilient plastic covered forms, template action figure body forms, flowers, and volcanoes with various shaped openings. The novel invention can be used with toy vehicles such as cars, trucks, tanks, planes, spaceships, trains, boats and the like, where a toy car can be pulled along a track. Alternatively, the novel magnetic gel can be mixed with colored food dye to form various desired colors.

9 Claims, 3 Drawing Sheets

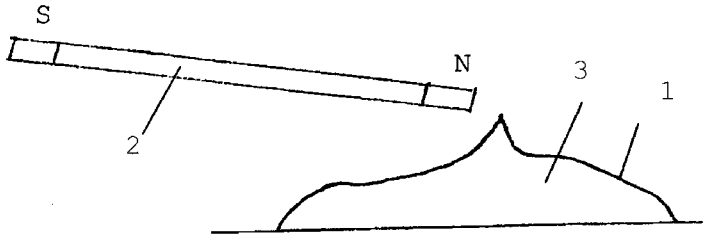
FIG. 1
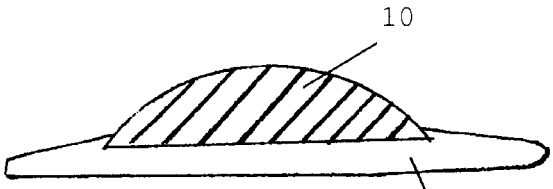
FIG. 2A
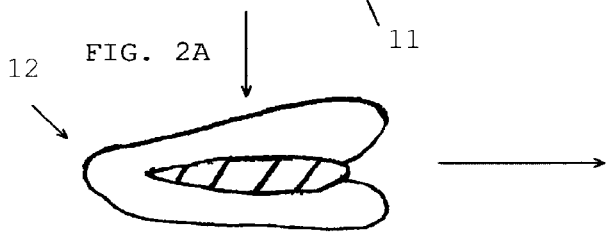
FIG. 2B
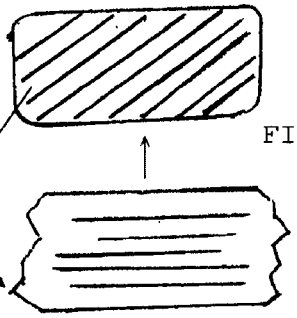
FIG. 2C
FIG. 2D
FIG. 3
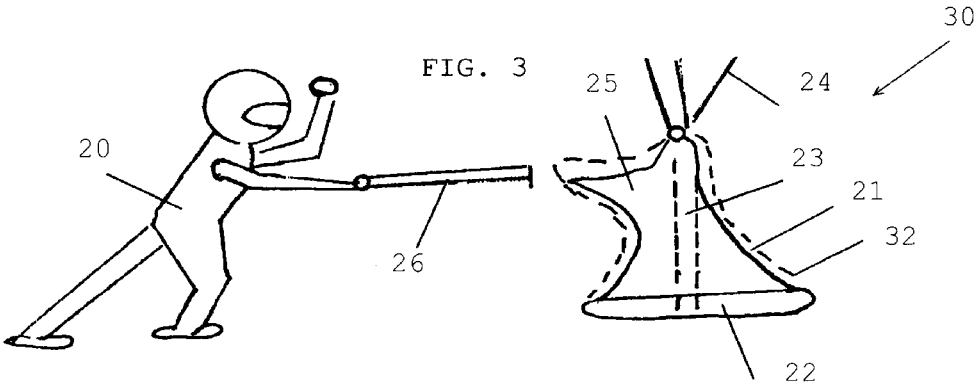

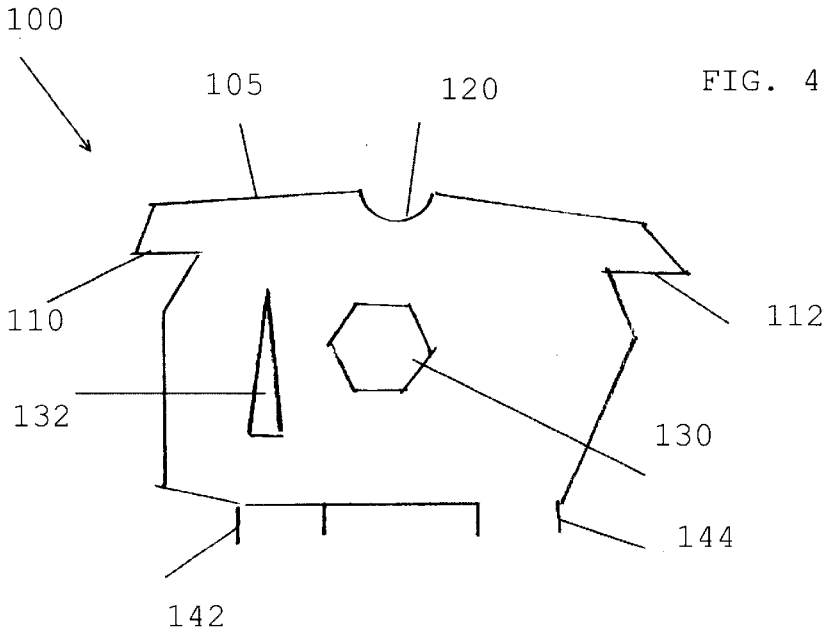
FIG. 4
FIG. 5
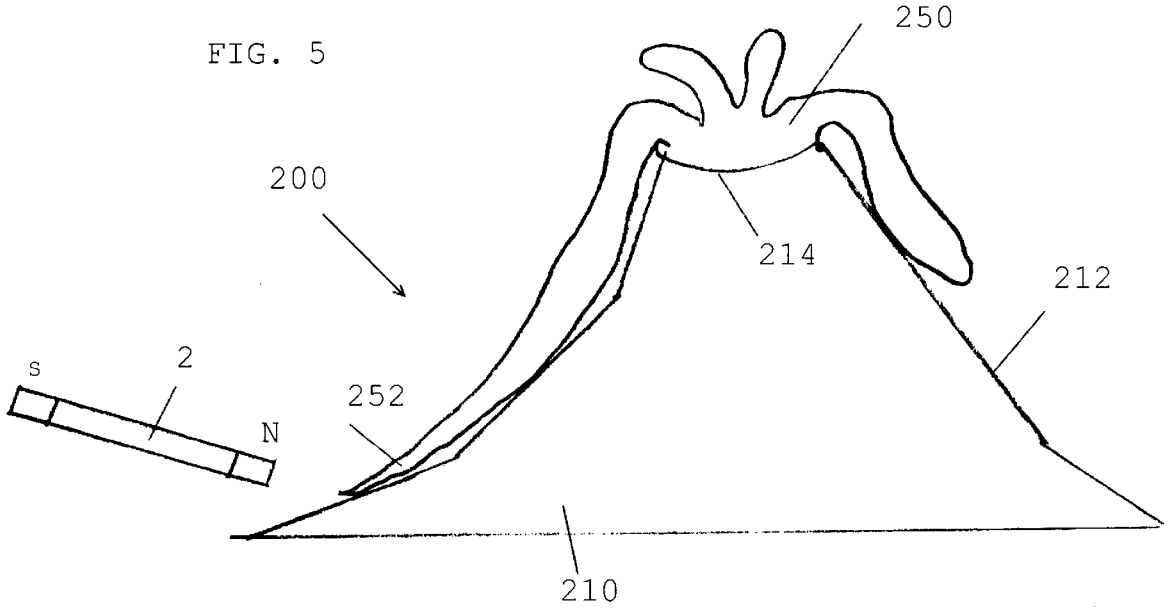

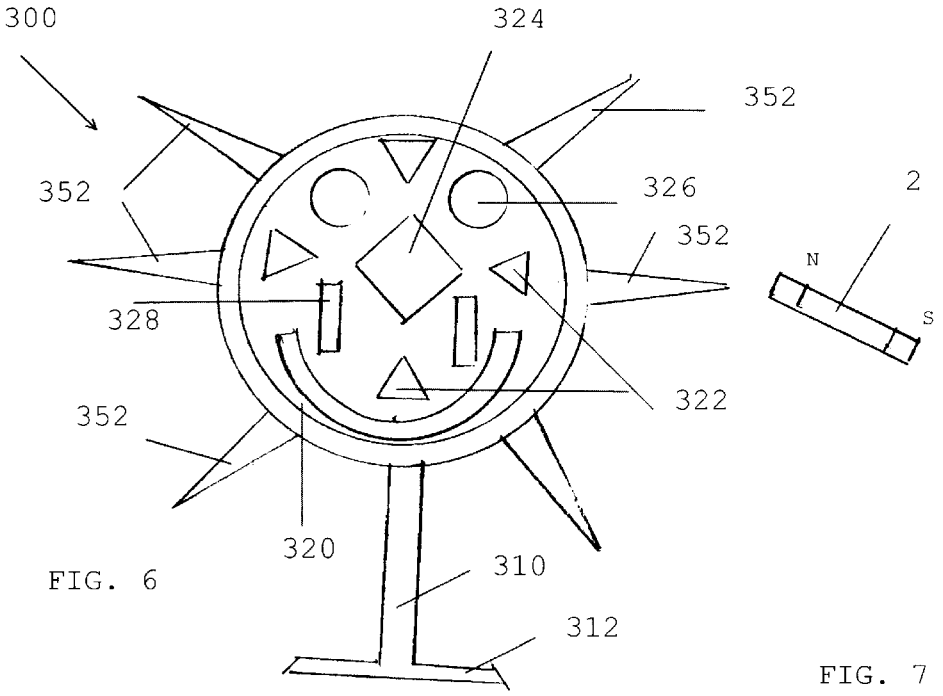
FIG. 6
FIG. 7
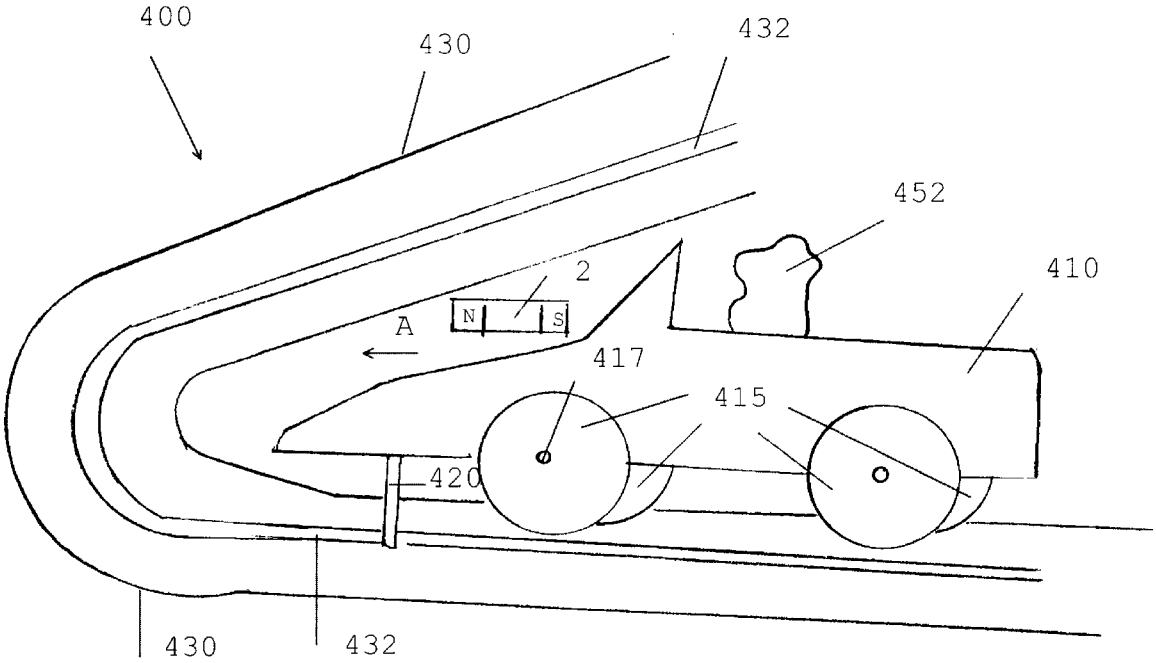

MAGNETIC GEL TOY AND METHOD FOR MAKING

This is a Continuation-In-Part of U.S. application Ser. No. 08/406,023 filed on Mar. 17, 1995 abandoned.

This invention relates to a magnetic gel, and in particular to a method and apparatus for creating and using a readily pliable magnetic gel as novelties, toys and playthings.

BACKGROUND AND PRIOR ART

Modeling clay, and silicone-based Silly Putty® and Gak®, have been popular materials used by children as novelties, toys and playthings.

The mysterious magnetic attraction of magnets has continuously provided the basis for many toys and novelties. Magnetic powders have found use in toys where pictures can be drawn by manipulating the powder through a transparent cover with a magnetic wand. Magnets have also been the basis of many other toys such as building sets where metal blocks are held together through magnetic attraction. U.S. Pat. No. 3,568,360 entitled: Toy with a Flexible Member and a Base Member One of Which is Magnetized, describes a toy wherein a Magnetized wand is used to move small bits of magnetic material to complete a picture underneath a transparent cover. A magnetic toy that is construction oriented is described in U.S. Pat. No. 3,714,612 entitled: Creative Magnetic Apparatus, where a magnetized platform is established that can be used to erect pieces of magnetizable material.

Attempts have been made to create magnetic type gels but have resulted with numerous problems. The following patents generally require carrier fluids such as "plasticizing oils", additives, toxic compounds, special manufacturing requirements such as high temperature heating, that make the resulting material expensive to manufacture, with a resultant unpliable surface texture and a composition that would be unsafe for children. U.S. Pat. No. 2,836,931 describes embedding a single magnetized metallic element into a preformed resilient-rubberized animal figure. U.S. Pat. No. 4,371,493, describes a silicone gelatinous material that uses a born compound as an additive and is similar to Silly Putty. A Gak-like, water-based material is described in U.S. Pat. No. 4,587,288, Silicone Water-Based Putty. A more recent formulation is U.S. Pat. No. 5,258,437, Silicone Putty Compositions, which uses boric acid or boron oxide as an additive. U.S. Pat. No. 4,316,699, entitled: Process for the Controlled Preparation of a Composite of Ultrafine Magnetic Particles Homogeneously Dispersed in a Dielectric Matrix, involves the formation of colloidal gel which is later cured to form a rigid material with magnetic properties. U.S. Pat. No. 4,341,176, entitled: Magnetic Gel Suitable to Immunoenzymatic Determinations, describes powered magnetic material mixed with a gel. U.S. Pat. No. 4,110,236 describes a nondestructive magnetic recording medium having a magnetizable putty like material. However, this patent does not describe any uses as a toy. Further, this patent does not describe any type of kneading process to form their mixture nor the controlling temperatures needed to do so. The use in the patent is entirely different, however, from that specified here. The gels are chemically selective media used for chemical and biochemical analysis and the magnetic particles are added to small pieces of the gel so as to make it easy to move the chemically selective gels during the processing steps in a chemical analysis. U.S. Pat. No. 5,153,254 to Chen describes a reusable lint remover having a gelatinous composition with "an elastic memory" that can include "utility as toys." However, this patent does not describe how the invention is useful as a toy. Furthermore, this patent requires elastic mixtures comprising tir-block polymers and a "plasticizing oil" and requires high temperatures of approximately 150 to 200 degrees C. to form. The emphasis of these prior art patents is thus entirely different from the objectives of the current invention as described below.

SUMMARY OF THE INVENTION

The first objective of the present invention is to provide a novel magnetic gel material having mechanical and thixotropic properties.

The second object of this invention is to provide a novel magnetic gel material that can be used as a novelty, toy and plaything for children.

The third object of this invention is to provide a novel magnetic gel having a bulk mass with a soft pliable feel useful as a toy, novelty and plaything.

The fourth object of this invention is to provide a novel magnetic gel having comprising inert and non-toxic materials in its composition that would be safe for children.

The fifth object of this invention is to provide a novel gel having a water-based composition that is combined with a inert non-toxic magnetic material through kneading at room/ambient temperature.

The sixth object of this invention is to provide a magnetic gel consisting of a water-based composition and inert non-toxic magnetic material that does not require adding a gelling agent to a ferrofluid material.

The seventh object of this invention is to provide a magnetic gel consisting of a water-based composition and inert non-toxic magnetic material that does not require a carrier fluid nor additives.

A preferred embodiment of the novel invention includes a gelatinous material such as silicone gel with a fine inert non-toxic magnetic powder dispersed throughout by kneading the powder and gel together at room/ambient temperature to produce a substantially uniform mixture that is child-safe and useful as a toy, novelty, and plaything. Various types of template action figure body forms, flowers, volcanoes, and toy vehicles with associated track are disclosed.

Further objects and advantages of this invention win be apparent from the following detailed description of a presently preferred embodiment which is illustrated schematically in the accompanying drawings.

BRIEF DESCRIPTION OF THE FIGURES

FIG. 1 illustrates the novel magnetic gel being attracted by a magnetic wand/rod.

FIGS. 2A, 2B, 2C and 2D illustrates the kneading process of mixing a magnetic powder thoroughly throughout a gelatinous material to form the novel magnetic gel of FIG. 1.

FIG. 3 illustrates a first preferred toy use of the novel magnetic gel of FIG. 1 interacting with an action figure.

FIG. 4 illustrates a template body form as a second preferred use of the magnetic gel of FIG. 1

FIG. 5 illustrates a third preferred use having volcano form using the magnetic gel used to simulate lava.

FIG. 6 illustrates a fourth preferred embodiment of a flower form using the magnetic gel of FIG. 1.

FIG. 7 illustrates a fifth preferred embodiment toy vehicle form using the magnetic gel of FIG. 1.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIG. 1 illustrates the bulk properties of a mass of the novel magnetic gel used with a magnetic rod/wand. The novel magnetic gel 1 is attracted to the permanent magnet rod/wand 2, producing a protuberance 3 that is wiggly and appears alive, giving good play value. Alternatively, reversing the orientation of rod/wand 2 can cause protuberance 3 to move away from the wand because of opposing magnetic forces.

FIGS. 2A–2D illustrates how the kneading process disperses the powered magnetic material throughout the gelatinous material. In FIG. 2A, magnetic powder 10, is placed on gelatinous material 11, which is folded over and stretched to form sandwich 12 shown in FIG. 2B. Repeated folding and stretching leads to a layered structure at 13 shown in FIG. 2C. Folding or kneading eventually reduces the distance between layers to the order of the size of the powder grains, so that a substantially uniform dispersal of the magnetic powder is achieved at 14 shown in FIG. 2D . The kneading process of FIGS. 2A–2D is accomplished at room/ambient temperature without any external high temperature heating sources nor the use of additives like surfactants as used with much of the prior art devices previously discussed in the background section of this invention.

Small samples of magnetic gel can be produced quite quickly by hand kneading as shown in FIGS. 2A–2D. Large scale production would make use of a kneading machinery, but the essential process of folding and stretching that comprise kneading is utilized. The mechanical properties of the gelatinous base eliminate the need for the surfactants and other additives that required to keep the magnetic particles in colloidal suspension in ferrofuids. During the kneading process, the magnetic particles are trapped within the gelatinous material and do not settle in response to gravity or dislodge in response to magnetic forces. The gelatinous mechanical properties are maintained with the addition of up to 25% or more magnetic powder by volume. When too high a percentage of powder is added, the resulting material becomes clay-like and rigid, loosing its gelatinous properties.

Magnetic powders 10 shown in FIG. 2A come from a variety of sources are useful for producing magnetic gels, but a very convenient source is to precipitate ferrous chloride and ferric chloride according to $$2FeCl_3+FeCl_2+8NaOH—8NaCl+4H_2O+Fe_3O_4(prec)$$

yielding magnetite $Fe_3O_4$ as a precipitate.

Gelatinous material 11 is preferably a water-based gelatinous material such as but not limited to silicone-based gel such as commercially available Gak® and Silly Putty®.

FIG. 3 illustrates an action figure interacting with a figure incorporating the novel magnetic gel. Action FIG. 20, is fighting a monster FIG. 30. The blob monster 30 is comprised of a base 22 and a vertical member 23 which is surrounded by ferrogel of magnetic gel 21. Atop the vertical member are affixed an alien appearing eye and antennae, 24. When the simulated magic permanent magnet sword 26 is brought near the monster 30, the monster seems to respond with an attaching pseudopod, 25, as a result of the attraction between the sword 26 and the magnetic gel 25. An optional resilient cover such as but not limited to clear transparent plastic and the like can be used as a drape shield 32 over the magnetic gel 21.

This example of play with the magnetic gel is not exhaustive. The magnetic gel's unique combination of magnetizability and thixotrophy give many play possibilities. For example, prior magnetic play toys as mentioned in the prior art section could potentially benefit from the substitution of magnetic gel for a magnetizable powders or other magnetizable parts.

FIG. 4 illustrates a template body form 100 as a second preferred toy use of the magnetic gel of FIG. 1. Template body form 100 can be a pre-injection molded plastic form in the shape of a body torso having various shaped openings for arm protrusions 110, 112 such a triangular shapes, a circular opening 120 for head protrusion, square openings 142, 144 for leg protrusions and an octagon shaped opening 130 as a chest protrusion. Optionally, body form 100 can include additional openings such as but not limited to ones for weapons 132 shaped as swords, daggers, guns and the like. The novel magnetic gel 1 of FIG. 1 can be inserted into the template body form 100 wherein wand/rod 2 can magnetically cause various body appendages to appear from the various shaped openings of FIG. 4. Template body form 100 can be transparent plastic while interior magnetic gel 1 include various colored magnetic gel such as a mixed additive of food coloring dye such as but not limited to red, orange, yellow, green, blue, white, and black either singularly or in combination with one another.

FIG. 5 illustrates a third embodiment use 200 of volcano form 210 having the magnetic gel 250 used to simulate lava. Form 210 can be formed from pre-injection molded plastic and the like to appear as a volcano having curved sides 212 which slope downward from a top mouth opening 214. Novel magnetic gel 250 can be initially inserted into the hollow interior cavity of the volcano form 210. Wand/rod 2 can then cause protuberances 252 to appear from the mouth 214 of the volcano. Various colors such as yellow and orange would help in giving protuberances 252 the look of lava.

FIG. 6 illustrates a fourth preferred embodiment 300 of a flower form using the magnetic gel of FIG. 1. Embodiment 300 includes a base 312, stem section 310 and cylindrical disc head portion 320 formed from pre-injection molded plastic and the like to simulate a flower. Various sized and shaped openings such as triangles 322, stars 324 circles 326 and rectangles/squares 326 are cut into the sides of the disc head 320. Magnetic gel protuberances 352 are pulled through the various shaped openings by magnetic rod/wand 2 where the protuberances form the shapes of the openings that they pass through. Base 312, and stem section 310 can be colored green while protuberances the magnetic gel 352 can include complementary colors such as orange, yellow, red and the like as previously described.

FIG. 7 illustrates a fifth preferred embodiment 400 of a toy vehicle form 410 using the magnetic gel of FIG. 1. Embodiment 400 can include a toy vehicle form in the shape of a sports car/race car having rotating wheels 415 rotatable about axles attached to body 410. Inside of vehicle 410 can be an action figure such as the template body of FIGS. 1 and 4 described previously. Underneath vehicle 410 is a extended rigid tongue flap 420 that slidably fits within a groove 432 of a track road 430. Wand/rod 2 can be used to magnetically pull the magnetic gel of figurine 452 causing toy vehicle 410 to move along track 432. Vehicle 410, wheels 415, tongue-flap 420 and track 430 can be formed from pre-injection molded plastic and the like.

While the toy vehicle depicted in FIG. 7 shows a toy car, other types of vehicles such as but not limited to a truck, tank, plane, spaceship, train and the like can be similarly used with the track.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A magnetic gel toy, comprising in combination:

a pliable magnetic gel material;

a magnet means; and a template having at least one opening, wherein the magnet means is used to pull a portion of the pliable magnetic gel material through the opening of the template, wherein interaction between the pliable magnetic gel material, the magnet means and the template are useful as a toy, novelty and plaything.

2. The magnetic-gel toy of claim 1, wherein the template includes:

a flower shape.

3. The magnetic-gel toy of claim 1, wherein the template includes:

a volcano shape having a lava forming mouth opening.

4. The magnetic-gel toy of claim 1, wherein the template includes:

a body shape having openings for at least one of: arms, legs and a head.

5. A method of making a plaything from interacting a magnet with pliable magnetic material and a template, comprising the steps of:

(a) positioning a non-toxic pliable gel material having magnetic components on one side of a template having at least one opening;

(b) positioning a magnet on a second side of the template opposite to the one side; and (c) pulling a portion of the pliable gel material through the opening with the magnet, so dimensions of the opening shape the portion into a selected shape.

6. The method of making a plaything of claim 5, wherein the template includes:

a flower shape.

7. The method of making a plaything of claim 5, wherein the template includes:

a volcano shape.

8. The method of making a plaything of claim 5, wherein the template includes:

a body shape having openings for at least one of: arms, legs and a head.

9. The method of making a plaything of claim 5, wherein the template includes:

shapes selected from at least one of: squares, rectangles, circles, half-circles, axis, and triangles.

* * * * *